US005673237A

United States Patent [19]

Blank

[11] Patent Number: 5,673,237

[45] Date of Patent: Sep. 30, 1997

[54] STEERING WHEEL ALARM CLOCK

[76] Inventor: Steve Blank, 6 Sturdevant Dr., Danbury, Conn. 06811

[21] Appl. No.: 592,971

[22] Filed: Jan. 29, 1996

[51] Int. Cl.[6] ..... G04B 47/00

[52] U.S. Cl. ..... 368/10

[58] Field of Search ..... 368/10

[56] References Cited

U.S. PATENT DOCUMENTS 4,601,584 7/1986 DeWolf et al. ..... 368/10

5,138,589 8/1992 Kimbel ..... 368/6

*Primary Examiner*—Bernard Roskoski

[57] ABSTRACT

A steering wheel alarm clock for mounting to a steering wheel and alerting a driver to a passage of a predetermined amount of time. The inventive device includes a housing having a semi-circular upper edge which can be positioned against an interior surface of a steering wheel. Straps extend from the housing and can be secured about the steering wheel to mount the housing thereto. An alarm clock module is mounted to the front face of the housing and can be manually operated to actuate a beeper to alert a driver to a passage of a predetermined length of time.

1 Claim, 3 Drawing Sheets

STEERING WHEEL ALARM CLOCK

BACKGROUND OF THE INVENTION

1. Field of the Invention

The present invention relates to alarm clocks and more particularly pertains to a steering wheel alarm clock for mounting to a steering wheel and alerting a driver to a passage of a predetermined amount of time.

2. Description of the Prior Art

The use of alarm clocks is known in the prior art. More specifically, alarm clocks heretofore devised and utilized are known to consist basically of familiar, expected and obvious structural configurations, notwithstanding the myriad of designs encompassed by the crowded prior art which have been developed for the fulfillment of countless objectives and requirements.

Known prior art alarm clocks include U.S. Pat. No. 5,353,013; U.S. Pat. No. 4,179,877; U.S. Pat. No. 5,253,230; U.S. Pat. No. 5,229,982; U.S. Design Pat. No. 286,381; and U.S. Design Pat. No 315,509.

While these devices fulfill their respective, particular objectives and requirements, the aforementioned patents do not disclose a steering wheel alarm clock for mounting to a steering wheel and alerting a driver to a passage of a predetermined amount of time which includes a housing having a semi-circular upper edge which can be positioned against an interior surface of a steering wheel, straps extending from the housing and securable about the steering wheel to mount the housing thereto, and an alarm clock module mounted to the front face of the housing which can be manually operated to actuate a beeper to alert a driver to a passage of a predetermined length of time.

In these respects, the steering wheel alarm clock according to the present invention substantially departs from the conventional concepts and designs of the prior art, and in so doing provides an apparatus primarily developed for the purpose of mounting to a steering wheel and alerting a driver to a passage of a predetermined amount of time.

SUMMARY OF THE INVENTION

In view of the foregoing disadvantages inherent in the known types of alarm clocks now present in the prior art, the present invention provides a new steering wheel alarm clock construction wherein the same can be utilized for mounting to a steering wheel and alerting a driver to a passage of a predetermined amount of time. As such, the general purpose of the present invention, which will be described subsequently in greater detail, is to provide a new steering wheel alarm clock apparatus and method which has many of the advantages of the alarm clocks mentioned heretofore and many novel features that result in a steering wheel alarm clock which is not anticipated, rendered obvious, suggested, or even implied by any of the prior art alarm clocks, either alone or in any combination thereof.

To attain this, the present invention generally comprises a steering wheel alarm clock for mounting to a steering wheel and alerting a driver to a passage of a predetermined amount of time. The inventive device includes a housing having a semi-circular upper edge which can be positioned against an interior surface of a steering wheel. Straps extend from the housing and can be secured about the steering wheel to mount the housing thereto. An alarm clock module is mounted to the front face of the housing and can be manually operated to actuate a beeper to alert a driver to a passage of a predetermined length of time.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new steering wheel alarm clock apparatus and method which has many of the advantages of the alarm clocks mentioned heretofore and many novel features that result in a steering wheel alarm clock which is not anticipated, rendered obvious, suggested, or even implied by any of the prior art alarm clocks, either alone or in any combination thereof.

It is another object of the present invention to provide a new steering wheel alarm clock which may be easily and efficiently manufactured and marketed.

It is a further object of the present invention to provide a new steering wheel alarm clock which is of a durable and reliable construction.

An even further object of the present invention is to provide a new steering wheel alarm clock which is susceptible of a low cost of manufacture with regard to both materials and labor, and which accordingly is then susceptible of low prices of sale to the consuming public, thereby making such steering wheel alarm clocks economically available to the buying public.

Still yet another object of the present invention is to provide a new steering wheel alarm clock which provides in the apparatuses and methods of the prior art some of the advantages thereof, while simultaneously overcoming some of the disadvantages normally associated therewith.

Still another object of the present invention is to provide a new steering wheel alarm clock for mounting to a steering wheel and alerting a driver to a passage of a predetermined amount of time.

Yet another object of the present invention is to provide a new steering wheel alarm clock which includes a housing having a semi-circular upper edge which can be positioned against an interior surface of a steering wheel, straps extending from the housing and securable about the steering wheel to mount the housing thereto, and an alarm clock module mounted to the front face of the housing which can be manually operated to actuate a beeper to alert a driver to a passage of a predetermined length of time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
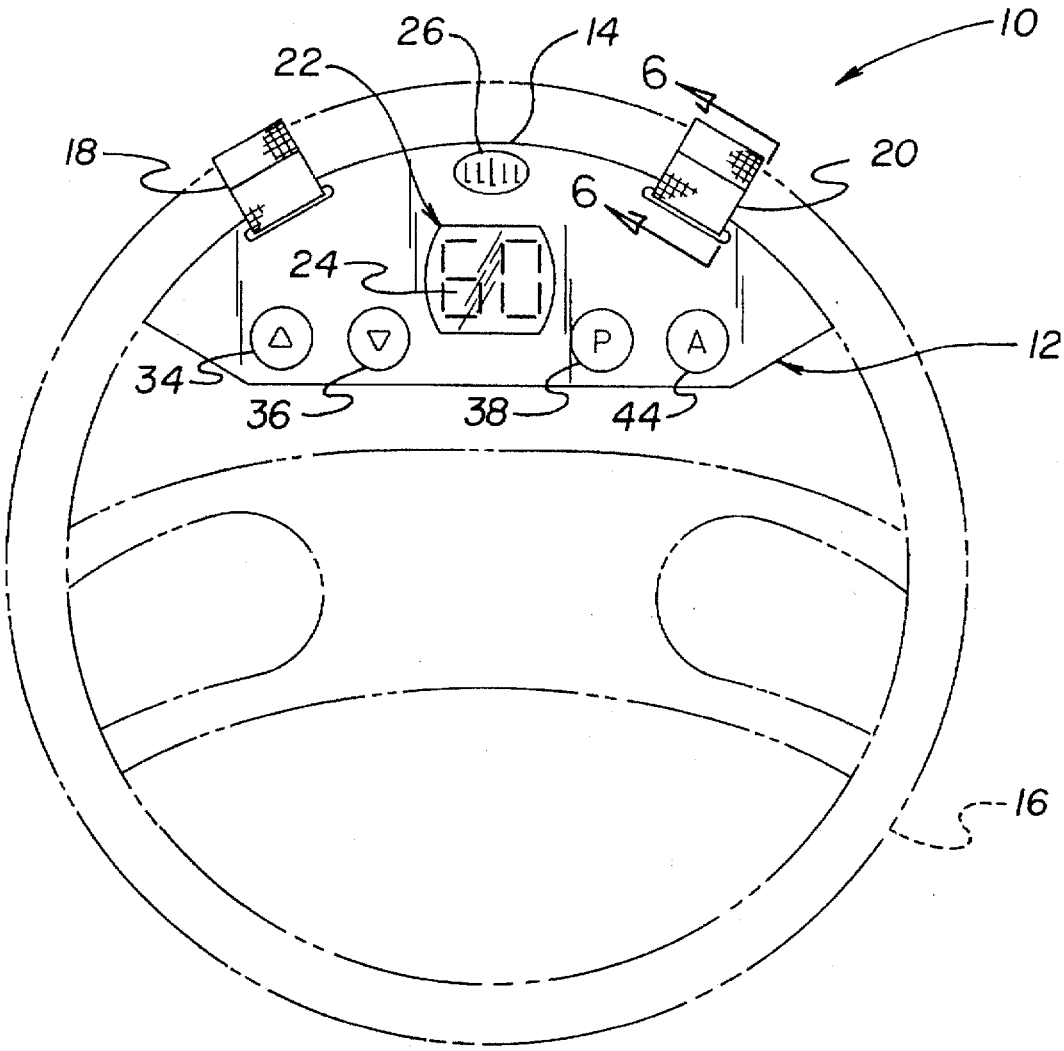
FIG. 1 is a front elevational view of the preferred embodiment of the steering wheel alarm clock constructed in accordance with the principles of the present invention.
Figure 2:
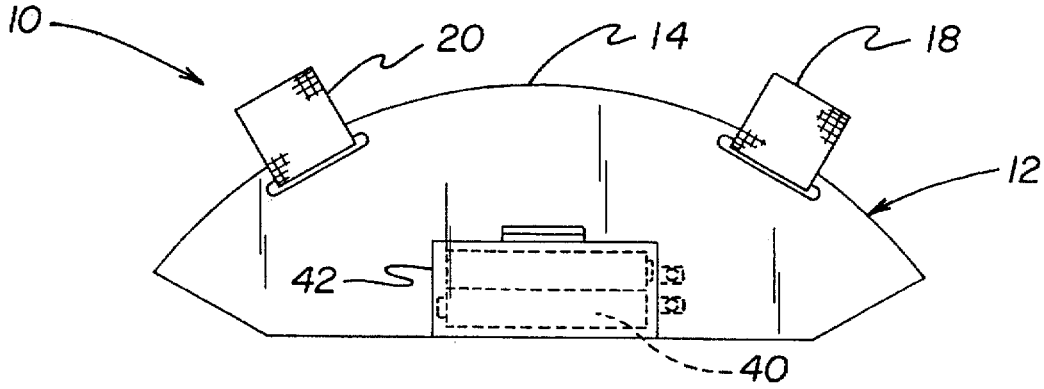
FIG. 2 is a rear elevational view of the present invention, per se.
Figure 3:
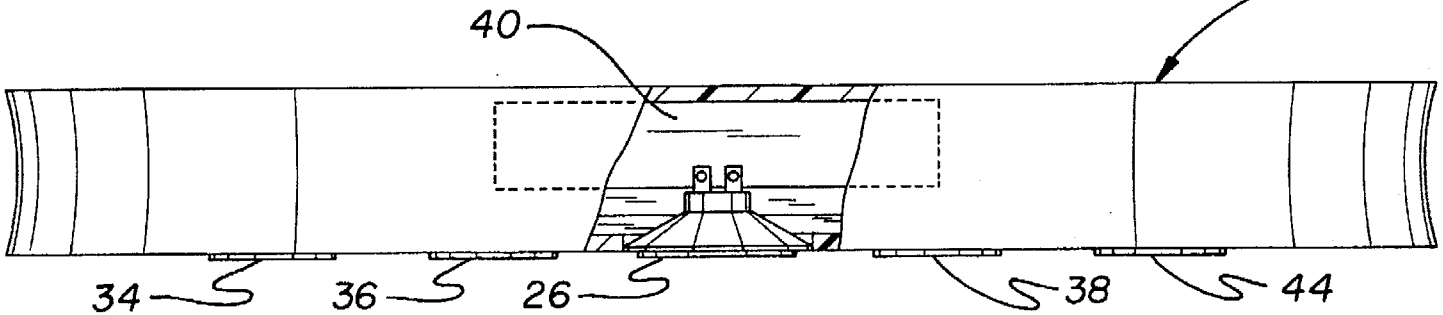
FIG. 3 is a top plan view, partially in cross section, of the invention.

With reference now to the drawings, and in particular to FIGS. 1–7 thereof, a new steering wheel alarm clock embodying the principles and concepts of the present invention and generally designated by the reference numeral 10 will be described.

More specifically, it will be noted that the steering wheel alarm clock 10 comprises a housing 12 having a semi-circular upper edge 14 which can be abuttingly positioned against an interior surface of a steering wheel 16 substantially as shown in FIG. 1 of the drawings. A pair of straps including a first strap 18 and a second strap 20 are mounted to the housing 12 and can be secured to about the steering wheel 16 to mount the invention 10 thereto. An electronic alarm clock module 22 is mounted within the housing 12 and includes a digital display 24 mounted on a front face of the housing 12. A beeper 26 is mounted to the housing and electrically coupled to the alarm clock module 22. By this structure, the alarm clock module 22 can be manually set to actuate the beeper 26 after a predetermined lapse of time to awaken a driver who has pulled off the road for a short nap, thereby increasing the safe driving of such person.

Figure 4:
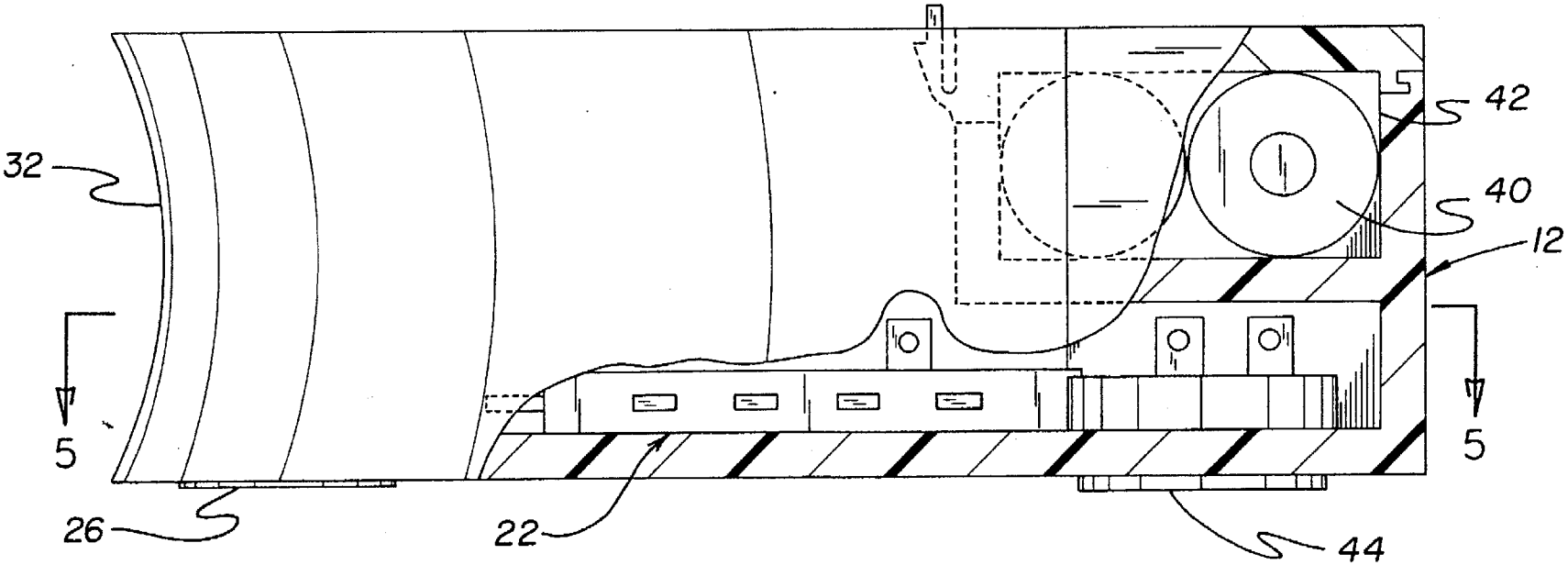
FIG. 4 is a side elevational view, partially in cross section, of the invention.
Figure 5:
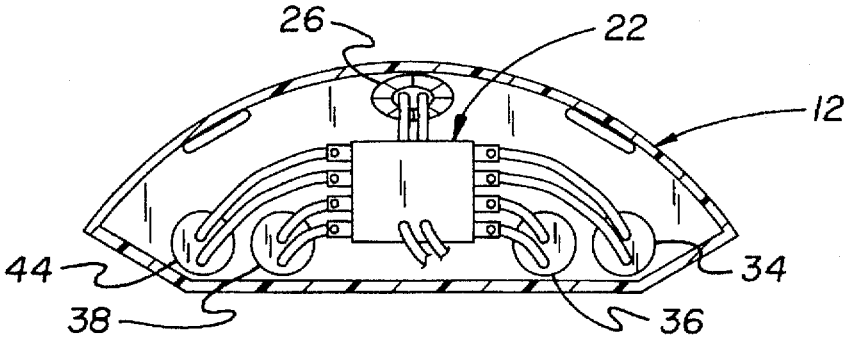
FIG. 5 is a rear cross sectional view taken along line 5—5 of FIG 4.
Figure 6:
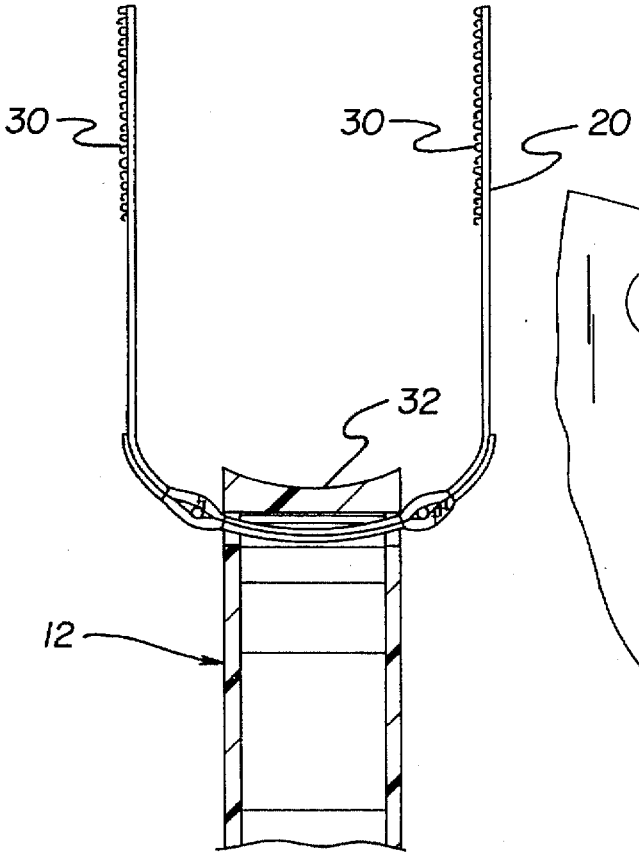
FIG. 6 is a cross sectional view taken along line 6—6 of FIG. 1.
Figure 7:
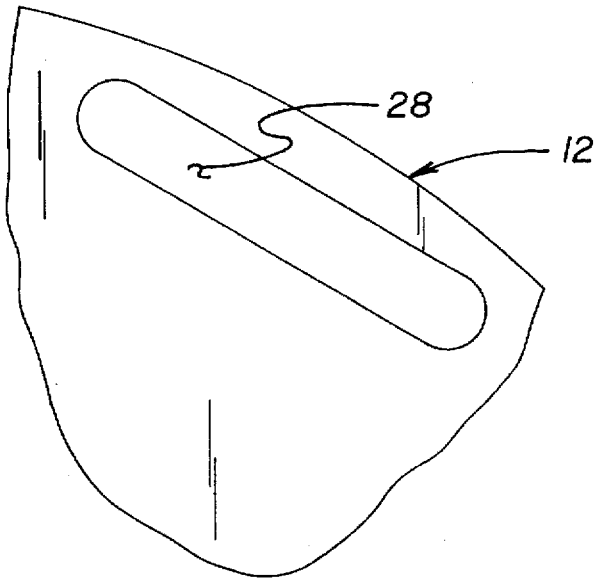
FIG. 7 is an enlarged elevational view of a portion of the invention.

As shown is FIGS. 6 and 7, the straps 18 and 20 are directed through strap slots 28 in the housing 12. To secure the straps 18 and 20 about the steering wheel 16, hook and loop fastening material 30 is secured to opposed ends of the straps and can be cooperatively secured together in a known fashion. To facilitate secure positioning of the housing 12 against the interior surface of the steering wheel 16, the semi-circular upper edge 14 of the housing 16 is shaped so as to define a concave surface 32, as shown in FIGS. 4 and 6.

Referring now to FIGS. 2 through 5, it can be shown that the alarm clock module 22 is mounted within the housing 12 and comprises conventionally known electronic components which are capable of actuating the beeper 26 after a predetermined length of time. Preferably, such length of time can be adjusted by an increase switch 34 and a decrease switch 36 which are mounted to the housing and electrically coupled to the module 22. A power switch 38 controls the connection of power from batteries 40 stored within a battery compartment 42 of the housing 12 to the alarm clock module 22. An alarm switch 44 is electrically coupled to the alarm clock module 22 and can be manually activated to start the alarm clock module running. Preferably, the alarm clock module counts down backwards from a greater number to a lesser number and actuates the beeper upon reaching zero.

In use, the steering wheel alarm clock 10 of the present invention 10 can be easily utilized for mounting to a steering wheel and alerting a driver to a passage of a predetermined amount of time. To this end, an individual can set the alarm clock module 22 to a predetermined number of minutes as shown by the digital display 24. The alarm actuation switch 44 can then be actuated to start the clock module 22 counting down. The beeper 26 will then sound at the end of the time to awaken the driver to continued the driver's journey after a nap or other break. The portable nature of the invention 10 allows the device to be easily transported and coupled to a desired automobile.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described,. and accordingly, all suitable modifications and equivalents may be resorted to, falling within the scope of the invention.

What is claimed as being new and desired to be protected by LETTERS PATENT of the United States is as follows:

1. A steering wheel alarm clock comprising:

a steering wheel;

a housing having a semi-circular upper edge which can be abuttingly positioned against an interior surface of a steering wheel, the housing is shaped so as to define a pair of strap slots, the semi-circular upper edge is shaped so as to define a concave surface;

a pair of straps including a first strap and a second strap mounted to the housing which can be secured about the steering wheel, the straps being directed through strap slots in the housing;

an electronic alarm clock module mounted within the housing, the electronic alarm clock module includes a digital display mounted on a front face of the housing, and a beeper mounted to the housing and electrically coupled to the alarm clock module the alarm clock module includes an increase switch and a decrease switch mounted to the housing and electrically coupled to the module for adjusting an amount of time for the alarm clock module to monitor.

* * * * *